US007913842B2

(12) United States Patent
Evans

(10) Patent No.: US 7,913,842 B2
(45) Date of Patent: Mar. 29, 2011

(54) LOOSEFILL PACKAGE FOR BLOWING WOOL MACHINE

(75) Inventor: Michael E. Evans, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/512,096

(22) Filed: Jul. 30, 2009

(65) Prior Publication Data

US 2009/0314672 A1 Dec. 24, 2009

Related U.S. Application Data

(63) Continuation-in-part of application No. 11/581,522, filed on Oct. 16, 2006.

(51) Int. Cl.

| | |
|---|---|
| ***B65D 71/00*** | (2006.01) |
| ***B65B 63/02*** | (2006.01) |
| ***B65B 13/20*** | (2006.01) |

(52) U.S. Cl. ..... 206/388; 206/83.5; 53/449; 53/459

(58) Field of Classification Search ..... 206/388, 206/321, 825, 83.5; 53/443, 449, 450, 452, 53/457, 459

See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |
| 2,308,197 | A | 1/1943 | Meyer |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner* — Jacob K Ackun, Jr.

(74) *Attorney, Agent, or Firm* — MacMillan, Sobanski & Todd, LLC

(57) ABSTRACT

Packages of compressed blowing wool are provided. The packages include at least two partial packages of compressed blowing wool. The partial packages have a body of compressed blowing wool encapsulated by a bag. The partial packages include an open end and a closed end. The open ends of the partial packages are configured to expose the body of compressed blowing wool. A joining mechanism is configured to join the partial packages into the package. The partial packages are joined such that the exposed bodies of compressed blowing wool in the open ends are substantially in contact with each other. The package is configured for separation into the partial packages and the partial packages are configured for loading into a blowing wool machine.

20 Claims, 10 Drawing Sheets

U.S. PATENT DOCUMENTS

| | | | |
|---|---|---|---|
| 2,311,773 | A | 2/1943 | Patterson |
| 2,355,358 | A | 8/1944 | Anderson |
| 2,404,678 | A | 7/1946 | Erb |
| 2,437,831 | A | 3/1948 | Moore |
| 2,532,318 | A | 12/1950 | Mackey et al. |
| 2,532,351 | A | 12/1950 | Wedebrock |
| 2,550,354 | A | 4/1951 | Jacobsen |
| 2,618,817 | A | 11/1952 | Slayter |
| 2,721,767 | A | 10/1955 | Kropp |
| 2,754,995 | A | 7/1956 | Switzer |
| 2,794,454 | A | 6/1957 | Moulthrop |
| 2,869,793 | A | 1/1959 | Montgomery |
| 2,938,651 | A | 5/1960 | Specht et al. |
| 2,964,896 | A | 12/1960 | Finocchiaro |
| 2,984,872 | A | 5/1961 | France |
| 2,989,252 | A | 6/1961 | Babb |
| 3,051,398 | A | 8/1962 | Babb |
| 3,076,659 | A | 2/1963 | Kremer |
| 3,175,866 | A | 3/1965 | Nichol |
| 3,201,007 | A | 8/1965 | Transeau |
| 3,231,105 | A | 1/1966 | Easley |
| 3,278,013 | A | 10/1966 | Banks |
| 3,314,732 | A | 4/1967 | Hagan |
| 3,399,931 | A | 9/1968 | Vogt |
| 3,403,942 | A | 10/1968 | Farnworth |
| 3,485,345 | A | 12/1969 | Deasy |
| 3,512,345 | A | 5/1970 | Smith |
| 3,556,355 | A | 1/1971 | Ruiz |
| 3,591,444 | A | 7/1971 | Hoppe et al. |
| 3,703,970 | A | 11/1972 | Benson |
| 3,747,743 | A | 7/1973 | Hoffman, Jr. |
| 3,861,599 | A | 1/1975 | Waggoner |
| 3,869,337 | A | 3/1975 | Hoppe et al. |
| 3,895,745 | A | 7/1975 | Hook |
| 3,952,757 | A | 4/1976 | Huey |
| 3,995,775 | A | 12/1976 | Birkmeier et al. |
| 4,059,205 | A | 11/1977 | Heyl |
| 4,129,338 | A | 12/1978 | Mudgett |
| 4,133,542 | A | 1/1979 | Janian et al. |
| 4,134,508 | A | 1/1979 | Burdett, Jr. |
| 4,155,486 | A | 5/1979 | Brown |
| 4,179,043 | A | 12/1979 | Fischer |
| 4,180,188 | A | 12/1979 | Anouma et al. |
| 4,236,654 | A | 12/1980 | Mello |
| 4,268,205 | A | 5/1981 | Vacca et al. |
| 4,273,296 | A | 6/1981 | Hoshall |
| 4,337,902 | A | 7/1982 | Markham |
| 4,344,580 | A | 8/1982 | Hoshall et al. |
| 4,346,140 | A | 8/1982 | Carlson et al. |
| 4,365,762 | A | 12/1982 | Hoshall |
| 4,381,082 | A | 4/1983 | Elliott et al. |
| 4,411,390 | A | 10/1983 | Woten |
| 4,465,239 | A | 8/1984 | Woten |
| 4,536,121 | A | 8/1985 | Stewart et al. |
| 4,537,333 | A | 8/1985 | Bjerregaard |
| 4,560,307 | A | 12/1985 | Deitesfeld |
| 4,585,239 | A | 4/1986 | Nicholson |
| 4,640,082 | A | 2/1987 | Gill |
| 4,695,501 | A | 9/1987 | Robinson |
| 4,716,712 | A | 1/1988 | Gill |
| 4,784,298 | A | 11/1988 | Heep et al. |
| 4,880,150 | A | 11/1989 | Navin et al. |
| 4,915,265 | A | 4/1990 | Heep et al. |
| 4,919,403 | A | 4/1990 | Bartholomew |
| 4,978,252 | A | 12/1990 | Sperber |
| 5,014,885 | A | 5/1991 | Heep et al. |
| 5,037,014 | A | 8/1991 | Bliss |
| 5,052,288 | A | 10/1991 | Marquez et al. |
| 5,129,554 | A | 7/1992 | Futamura |
| 5,156,499 | A | 10/1992 | Miklich |
| 5,166,236 | A | 11/1992 | Alexander et al. |
| 5,289,982 | A | 3/1994 | Andersen |
| 5,303,672 | A | 4/1994 | Morris |
| 5,323,819 | A | 6/1994 | Shade |
| 5,368,311 | A | 11/1994 | Heyl |
| 5,380,094 | A | 1/1995 | Schmidt et al. |
| 5,392,964 | A | 2/1995 | Stapp et al. |
| 5,405,231 | A | 4/1995 | Kronberg |
| 5,462,238 | A | 10/1995 | Smith et al. |
| 5,472,305 | A | 12/1995 | Ikeda et al. |
| 5,511,730 | A | 4/1996 | Miller et al. |
| 5,601,239 | A | 2/1997 | Smith et al. |
| 5,620,116 | A | 4/1997 | Kluger et al. |
| 5,624,742 | A | 4/1997 | Babbitt et al. |
| 5,639,033 | A | 6/1997 | Miller et al. |
| 5,642,601 | A | 7/1997 | Thompson, Jr. et al. |
| 5,647,696 | A | 7/1997 | Sperber |
| 5,683,810 | A | 11/1997 | Babbitt et al. |
| 5,819,991 | A | 10/1998 | Kohn et al. |
| 5,829,649 | A | 11/1998 | Horton |
| 5,860,232 | A | 1/1999 | Nathenson et al. |
| 5,860,606 | A | 1/1999 | Tiedeman et al. |
| 5,927,558 | A | 7/1999 | Bruce |
| 5,934,809 | A | 8/1999 | Marbler |
| 5,987,833 | A | 11/1999 | Heffelfinger et al. |
| 5,997,220 | A | 12/1999 | Wormser |
| 6,004,023 | A | 12/1999 | Koyanagi et al. |
| 6,036,060 | A | 3/2000 | Munsch et al. |
| 6,070,814 | A | 6/2000 | Deitesfeld |
| 6,074,795 | A | 6/2000 | Watamabe et al. |
| 6,109,488 | A | 8/2000 | Horton |
| 6,161,784 | A | 12/2000 | Horton |
| 6,209,724 | B1 | 4/2001 | Miller |
| 6,266,843 | B1 | 7/2001 | Donan et al. |
| 6,296,424 | B1 | 10/2001 | Ecket et al. |
| 6,312,207 | B1 | 11/2001 | Rautiainen |
| 6,503,026 | B1 | 1/2003 | Mitchell |
| 6,510,945 | B1 | 1/2003 | Allwein et al. |
| 6,648,022 | B2 | 11/2003 | Pentz et al. |
| 6,698,458 | B1 | 3/2004 | Sollars |
| 6,779,691 | B2 | 8/2004 | Cheng |
| 6,783,154 | B2 | 8/2004 | Persson et al. |
| 6,796,748 | B1 | 9/2004 | Sperber |
| 6,826,991 | B1 | 12/2004 | Ramussen |
| 7,284,715 | B2 | 10/2007 | Dziesinski et al. |
| 7,354,466 | B2 | 4/2008 | Dunning et al. |
| 2001/0036411 | A1 | 11/2001 | Walker |
| 2003/0075629 | A1 | 4/2003 | Lucas |
| 2003/0192589 | A1 | 10/2003 | Jennings |
| 2003/0215165 | A1 | 11/2003 | Hogan et al. |
| 2003/0234264 | A1 | 12/2003 | Landau |
| 2004/0028847 | A1* | 2/2004 | Teague et al. ..... 428/34.1 |
| 2004/0124262 | A1 | 7/2004 | Bowman et al. |
| 2005/0006508 | A1 | 1/2005 | Roberts |
| 2005/0242221 | A1 | 11/2005 | Rota |
| 2006/0024456 | A1 | 2/2006 | O'Leary et al. |
| 2006/0024457 | A1 | 2/2006 | O'Leary et al. |
| 2006/0024458 | A1 | 2/2006 | O'Leary et al. |
| 2006/0231651 | A1 | 10/2006 | Evans et al. |
| 2007/0054082 | A1* | 3/2007 | Beyer et al. ..... 428/43 |
| 2007/0138211 | A1 | 6/2007 | O'Leary et al. |
| 2008/0087751 | A1 | 4/2008 | Johnson et al. |
| 2008/0115460 | A1* | 5/2008 | Ruid et al. ..... 53/428 |

FOREIGN PATENT DOCUMENTS

| | | |
|---|---|---|
| DE | 3240126 | 5/1984 |
| EP | 0265751 | 4/1988 |
| FR | 2350450 | 3/1979 |
| GB | 1418882 | 12/1975 |
| GB | 1574027 | 9/1980 |
| GB | 2099776 | 12/1982 |
| GB | 2124194 | 2/1984 |
| GB | 2156303 | 10/1985 |
| GB | 2212471 | 7/1989 |
| GB | 2276147 | 9/1994 |
| JP | 407088985 | 4/1995 |
| NL | 8204888 | 7/1984 |

OTHER PUBLICATIONS

Hearing Testimony, Case No. 09 CV 263 Division 2, Boulder County District Court, Colorado, Apr. 29, 2009, 14 pages.

Hearing Testimony, Case No. 09 CV 263 Division 2, Boulder County District Court, Colorado, Apr. 30, 2009, 35 pages.

Hearing Testimony, Case No. 09 CV 263, Boulder County District Court, Colorado, May 1, 2009, 18 pages.

Hearing Testimony, Case No. 09 CV 263 Division 2, Boulder County

District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. by Unisul, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm-4/14/09, OC002923-OC002925, 3 pages.
The Quantum Insulation Blower, Intec, Frederick, CO, http://www.inteccorp.com/Quantum.htm-4/14/09, OC002930-OC002931, 2 pages.
The Wasp Insulation Blower, Intec, Frederick, CO, http://www.intec-corp.com/Wasp.com-5/18/05, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV 3/04, CT0000008-CT0000055, 50 pages.
Insulation Blowers—Accul 9118, Insulation Machine Corp., Springfield, MA, Copyright 2006, http://accuone.com/accul_9118.html-4/4/09, CT0000056-CT0000057, 2 pages.
AccuOne 9400, AccuOne Industries, Inc., Copyright 1998, http://www.accu1.com/A9400.html-7/13/04, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp?PartNo=450A-7/13/04, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html-4/6/09, CT0000449-CT0000451, 3 pages.
X-Floc Zellofant M95, X-Floc GmbH, Renningen, Germany, Feb. 8, 2009, http://www.x-floc.com/en/machines/zellofant-m95.html-4/13/09, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.html-4/4/09, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp-1/4/08, CT0000606-CT0000608, 3 pages.
Cocoon—Attic Insulation Blowing Machine, Exhibit II, 2 pages.
U.S. Appl. No. 10/899,909—Advisory Action May 26, 2009.
U.S. Appl. No. 10/899,909—Response to Final May 12, 2009.
U.S. Appl. No. 10/899,909—Final Rejection Mar. 20, 2009.
U.S. Appl. No. 10/899,909—Rejection Sep. 20, 2007.
U.S. Appl. No. 10/899,909—Rejection Apr. 4, 2008.
U.S. Appl. No. 10/899,909—Rejection Sep. 9, 2008.
U.S. Appl. No. 10/899,909—Response Aug. 27, 2007.
U.S. Appl. No. 10/899,909—Response Dec. 20, 2007.
U.S. Appl. No. 10/899,909—Response May 16, 2008.
U.S. Appl. No. 10/899,909—Response Jan. 7, 2009.
U.S. Appl. No. 10/899,909—Restriction Jul. 31, 2007.
U.S. Appl. No. 11/024,093—3 month office action Mar. 2, 2007.
U.S. Appl. No. 11/024,093—3 month office action Jul. 12, 2007.
U.S. Appl. No. 11/024,093—3 month office action Mar. 5, 2009.
U.S. Appl. No. 11/024,093—Advisory Action Jan. 11, 2008.
U.S. Appl. No. 11/024,093—Final 3 month Oct. 24, 2007.
U.S. Appl. No. 11/024,093—RCE Jan. 22, 2008.
U.S. Appl. No. 11/024,093—Response Jan. 24, 2007.
U.S. Appl. No. 11/024,093—Response Jun. 4, 2007.
U.S. Appl. No. 11/024,093—Response Oct. 12, 2007.
U.S. Appl. No. 11/024,093—Response Dec. 20, 2007.
U.S. Appl. No. 11/024,093—Response May 28, 2009.
U.S. Appl. No. 11/024,093—Restriction Nov. 24, 2006.
U.S. Appl. No. 11/303,612—3 Month Oct. 15, 2009.
U.S. Appl. No. 11/303,612—Final 3 Month Apr. 30, 2009.
U.S. Appl. No. 11/452,554—3 Month Office Action Apr. 8, 2008.
U.S. Appl. No. 11/452,554—Advisory Action Feb. 6, 2009.
U.S. Appl. No. 11/452,554—Final 3 Month Oct. 15, 2008.
U.S. Appl. No. 11/452,554—Final 3 Month May 5, 2009.
U.S. Appl. No. 11/452,554—RCE Mar. 11, 2009.
U.S. Appl. No. 11/452,554—Response Jun. 4, 2008.
U.S. Appl. No. 11/452,554—Response After Final Jan. 14, 2009.
U.S. Appl. No. 11/581,660—3 month office May 28, 2009.
U.S. Appl. No. 11/581,661—3 Month Apr. 3, 2008.
U.S. Appl. No. 11/581,661—3 Month May 5, 2009.
U.S. Appl. No. 11/581,661—Advisory Action Jan. 27, 2009.
U.S. Appl. No. 11/581,661—Final 3 Month Dec. 3, 2008.
APSCO—Pneumatic Conveying: Dilute Phase Systems, Dense Phase Systems . . . .
Choosing a pneumatic conveying system . . . ; Powder Bulk Engineering; Steve Grant.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303,612—Response Jan. 14, 2009.
U.S. Appl. No. 11/581,661—Response Jul. 17, 2008.
U.S. Appl. No. 11/303,612—Response AF Jun. 29, 2009.
U.S. Appl. No. 11/581,661—Response AF Jan. 9, 2009.
U.S. Appl. No. 11/581,661—Response; RCE Feb. 25, 2009.

* cited by examiner

LOOSEFILL PACKAGE FOR BLOWING WOOL MACHINE

RELATED APPLICATIONS

This application is a Continuation-In-Part application of pending U.S. patent application Ser. No. 11/581,522, filed Oct. 16, 2006, and entitled PARTIALLY CUT LOOSEFILL PACKAGE, all of which is incorporated in the present application in its entirety.

TECHNICAL FIELD

This invention relates to loosefill insulation for insulating buildings. More particularly this invention relates to distributing packaged loosefill insulation.

BACKGROUND OF THE INVENTION

In the insulation of buildings, a frequently used insulation product is loosefill insulation. In contrast to the unitary or monolithic structure of insulation baits or blankets, loosefill insulation is a multiplicity of discrete, individual tufts) cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if the blowing wool packages could be improved to make them easier to use.

SUMMARY OF THE INVENTION

According to this invention there are provided packages of compressed blowing wool. The packages include at least two partial packages of compressed blowing wool. The partial packages have a body of compressed blowing wool encapsulated by a bag. The partial packages include an open end and a closed end. The open ends of the partial packages are configured to expose the body of compressed blowing wool. A joining mechanism is configured to join the partial packages into the package. The partial packages are joined such that the exposed bodies of compressed blowing wool in the open ends are substantially in contact with each other. The package is configured for separation into the partial packages and the partial packages are configured for loading into a blowing wool machine.

According to this invention there is also provided packages of compressed blowing wool. The packages include at least two partial packages of compressed blowing wool. The partial packages have a body of compressed blowing wool encapsulated by a bag. The partial packages include an open end and a closed end. The open ends of the partial packages are configured to expose the body of compressed blowing wool. Protective caps are configured to cover the open ends of the partial packages. A joining mechanism is configured to join the partial packages into the package. The partial packages are joined such that the protective caps are substantially in contact with each other. The package is configured for separation into the partial packages and the partial packages are configured for loading into a blowing wool machine.

According to this invention there is also provided methods of forming a package of compressed blowing wool. The methods include compressing a body of blowing wool, encapsulating the body of compressed blowing wool in a bag, dividing the bag of compressed blowing wool into partial packages, the partial packages having an open end and a closed end, the open ends of the partial packages are configured to expose the body of compressed blowing wool and joining the partial packages thereby forming the package of compressed blowing wool. The partial packages are joined such that the exposed bodies of compressed blowing wool in the open ends are substantially in contact with each other. The package is configured for separation into the partial packages and the partial packages are configured for loading into a blowing wool machine.

According to this invention there is also provided methods of distributing blowing wool from a package of compressed blowing wool. The methods include providing a package of compressed blowing wool, the package including at least two partial packages of compressed blowing wool, the partial packages having a body of compressed blowing wool encapsulated by a bag, the partial packages including an open end and a closed end, and a joining mechanism configured to join the partial packages into the package, the open ends of the partial packages are configured to expose the body of compressed blowing wool, wherein the partial packages are joined such that the exposed bodies of compressed blowing wool in the open ends are substantially in contact with each other, wherein the package is configured for separation into the partial packages, and wherein the partial packages are configured for loading into a blowing wool machine, cutting the package along a suggested cut line such that the package divides into the partial packages, gripping the closed end of the partial package, feeding the open end of the partial package into a machine for shredding and picking apart the blowing wool; and withdrawing the empty partial package from the machine.

Various objects and advantages of this invention will become apparent to those skilled in the art from the following detailed description of the preferred embodiment, when read in light of the accompanying drawings.

DETAILED DESCRIPTION OF THE INVENTION

Figure 1:
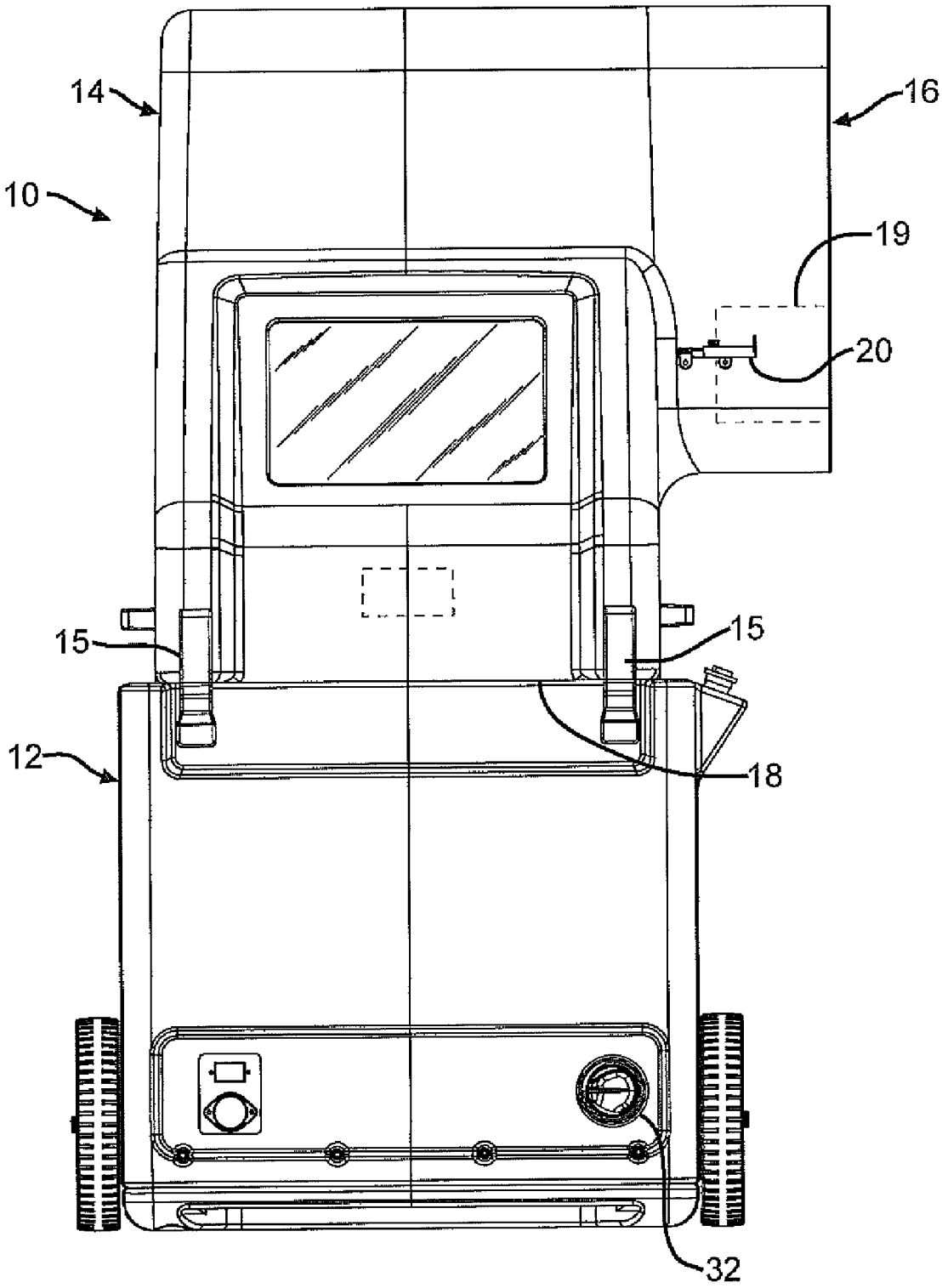
FIG. 1 is a front view in elevation of an insulation blowing wool machine.
Figure 2:
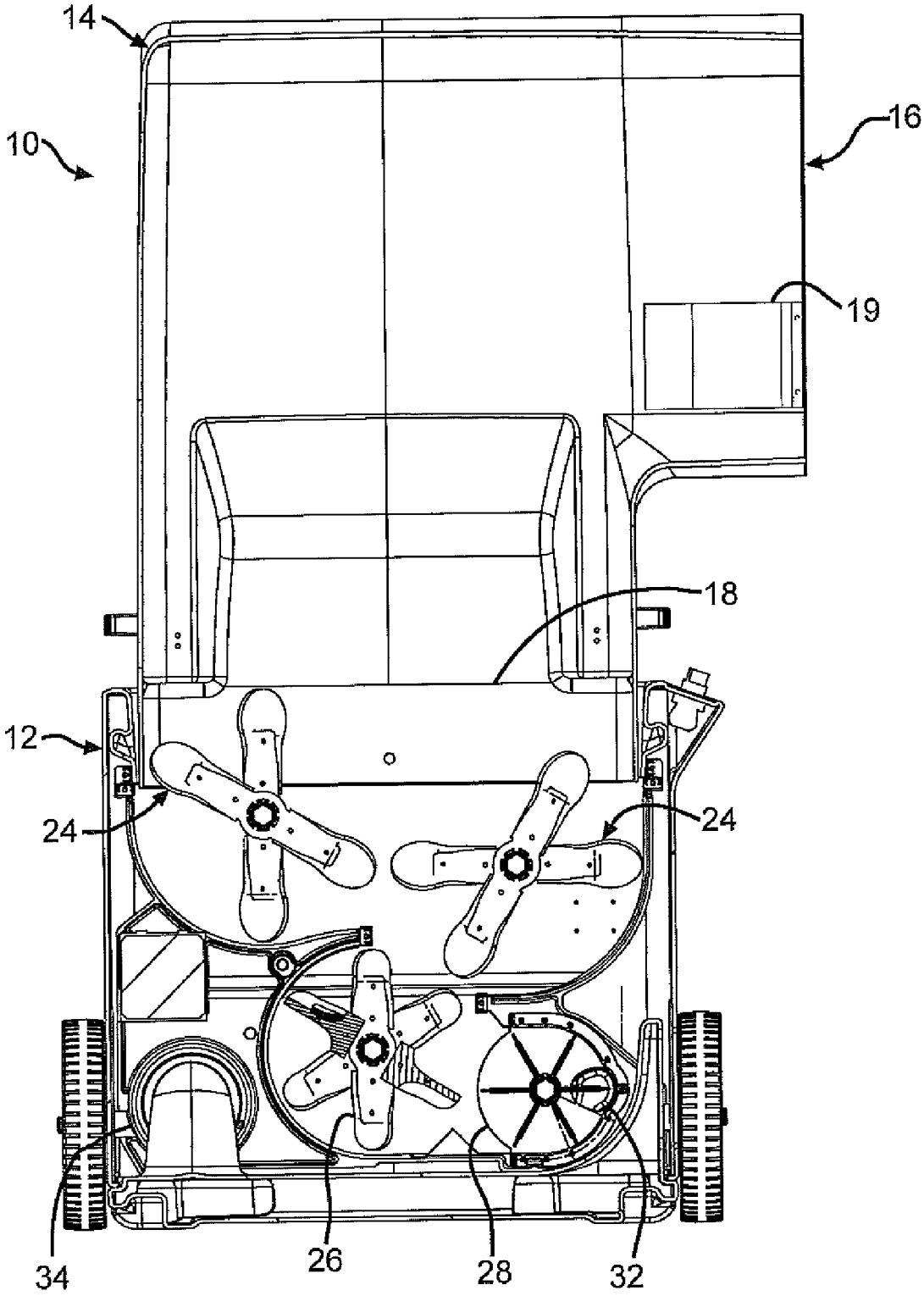
FIG. 2 is a front view in elevation, partially in cross-section, of the insulation blowing wool machine of FIG. 1.
Figure 3:
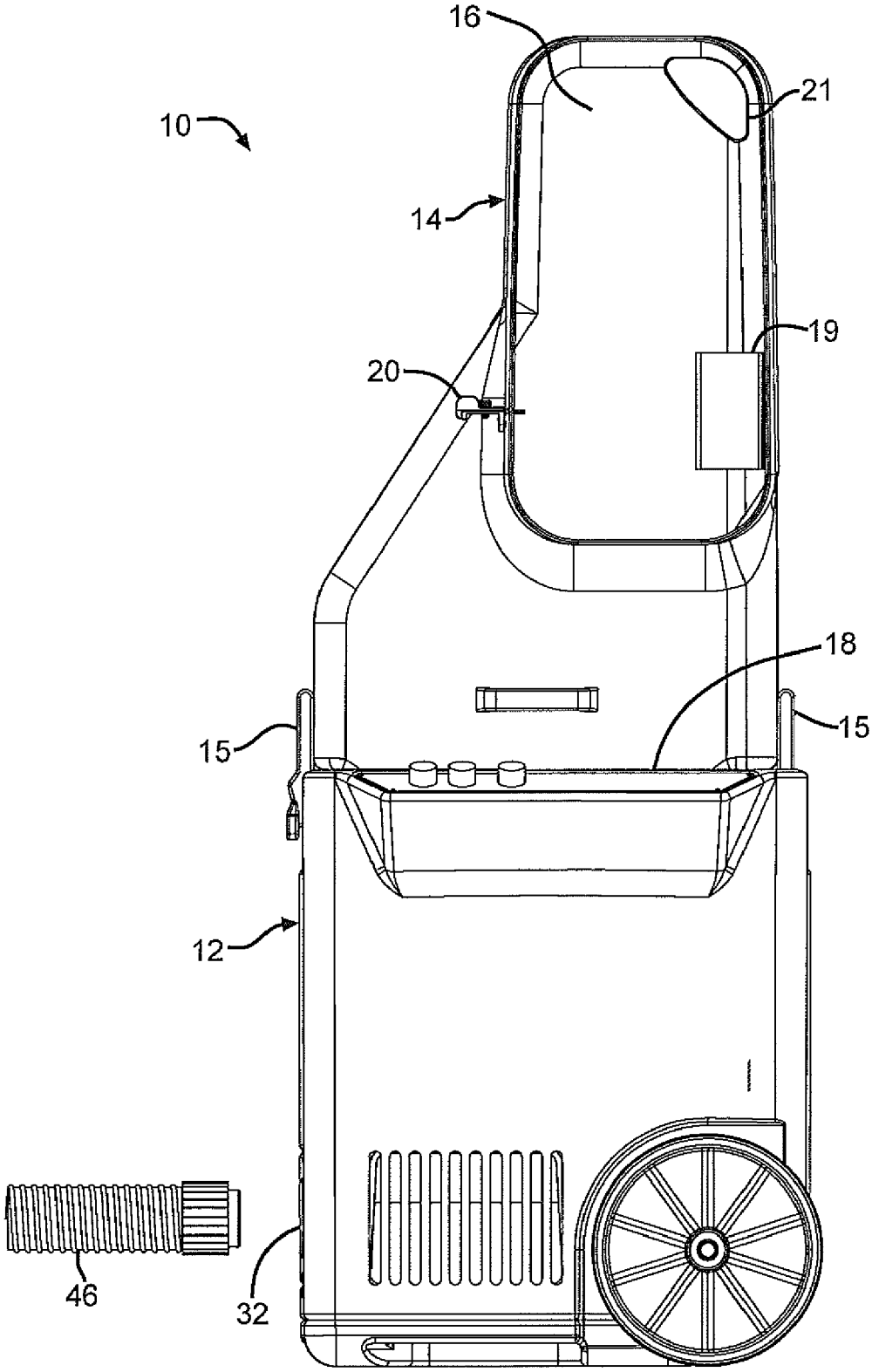
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to the low speed shredders 24 as shown in FIG. 2. Optionally, the chute 14 includes a handle segment 21, as shown in FIG. 3, to facilitate ready movement of the blowing wool machine 10 from one location to another. However, the handle segment 21 is not necessary to the operation of the machine 10.

As further shown in FIGS. 1-3, the chute 14 includes an optional guide assembly 19 at the inlet end 16 of the chute 14. The guide assembly 19 is configured to urge a package of compressed blowing wool against a cutting mechanism 20 as the package moves into the chute 14.

As shown in FIG. 2, the low speed shredders 24 are mounted in the lower unit 12 at the outlet end 18 of the chute 14. The low speed shredders 24 are configured to shred and pick apart the blowing wool as the blowing wool is discharged from the outlet end 18 of the chute 14 into the lower unit 12. Although the disclosed blowing wool machine 10 is shown with a plurality of low speed shredders 24, any type of separator, such as a clump breaker, beater bar or any other mechanism that shreds and picks apart the blowing wool can be used.

As further shown in FIG. 2, an agitator 26 is provided for final shredding of the blowing wool and for preparing the blowing wool for distribution into an airstream. A discharge mechanism 28 is positioned downstream from the agitator 26 to distribute the shredded blowing wool into the airstream. The discharge mechanism 28 can be a rotary valve, or any other mechanism including staging hoppers, metering devices, rotary feeders, sufficient to distribute the shredded blowing wool into an airstream. The shredded blowing wool is driven through the discharge mechanism 28 and through a machine outlet 32 by an airstream provided by a blower (not shown) mounted in the lower unit 12.

The shredders 24, agitator 26 and the discharge mechanism 28 are mounted for rotation. They can be driven by any suitable means, such as by a motor 34, or any other means sufficient to drive rotary equipment. Alternatively, each of the shredders 24, agitator 26, and discharge mechanism 28 can be provided with its own motor.

In general, the chute 14 guides the blowing wool to the low speed shredders 24 which shred and pick apart the blowing wool. The shredded blowing wool drops from the low speed shredders 24 into the agitator 26. The agitator 26 prepares the blowing wool for distribution into an airstream by further shredding the blowing wool. The finely shredded blowing wool drops from the agitator 26 into the discharge mechanism 28 for distribution into the airstream caused by the blower. The airstream, with the shredded blowing wool, exits the machine 10 at the machine outlet 32 and flows through a distribution hose 46, as shown in FIG. 3, toward the insulation cavity, not shown.

In one embodiment as shown in FIG. 3, the chute 14 has a substantially rectangular cross-sectional shape that approximates the substantially rectangular cross-sectional shape of a package 70 of compressed blowing wool. In one embodiment, the package 70 has a height of about 8 inches, a width of about 19 inches and a length of about 38 inches. Such a package 70 might have a weight of about 35 pounds, although the package 70 can weigh more or less than 35 pounds. In this embodiment, the chute 14 has a substantially rectangular cross-section shape of about 9 inches by 20 inches. The substantially rectangular cross-sectional shape of the chute 14 allows the package 70 to be easily received and fed through the chute 14 and to be engaged by the low speed shredders 24.

Figure 4:
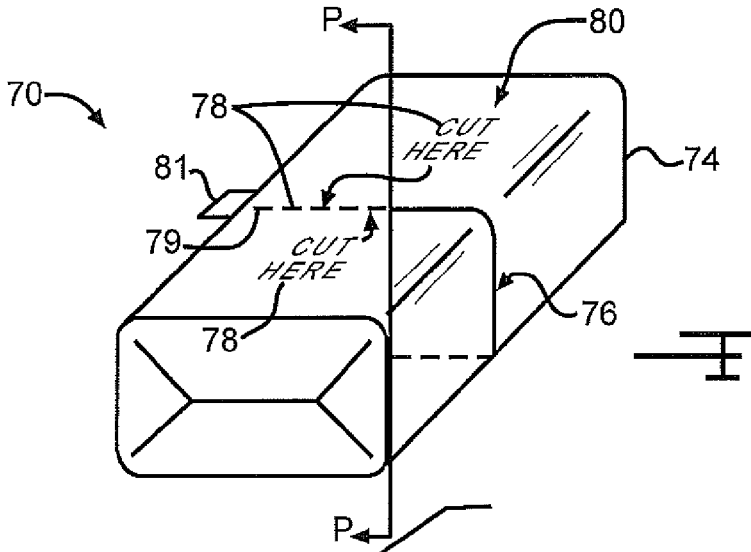
FIG. 4 is a perspective view of a package of compressed blowing wool.

As shown in FIG. 4, the package 70 of compressed blowing wool includes a bag 74 that encapsulates a body of compressed blowing wool. The bag 74 is made of a polymeric material, such as polyethylene, although any type of material suitable for maintaining the blowing wool in the desired compression can be used. The bag 74 provides a waterproof barrier against water, dirt and other deleterious effects. By using a polymeric material for the bag 74, the compressed blowing wool will be protected from the elements during transportation and storage of the package 70.

The compressed blowing wool in the package 70 can be any loosefill insulation, such as a multiplicity of discrete, individual tuffs, cubes, flakes, or nodules. The blowing wool can be made of glass fibers or other mineral fibers, and can also be organic fibers or cellulose fibers. The blowing wool can have a binder material applied to it, or it can be binderless. The blowing wool in the package 70 is compressed to a compression ratio of at least 10:1, which means that the unconstrained blowing wool, after the bag 74 is opened, has a volume of 10 times that of the compressed blowing wool in the bag 74. Other compression ratios higher or lower than 10:1 can be used.

Figure 5:
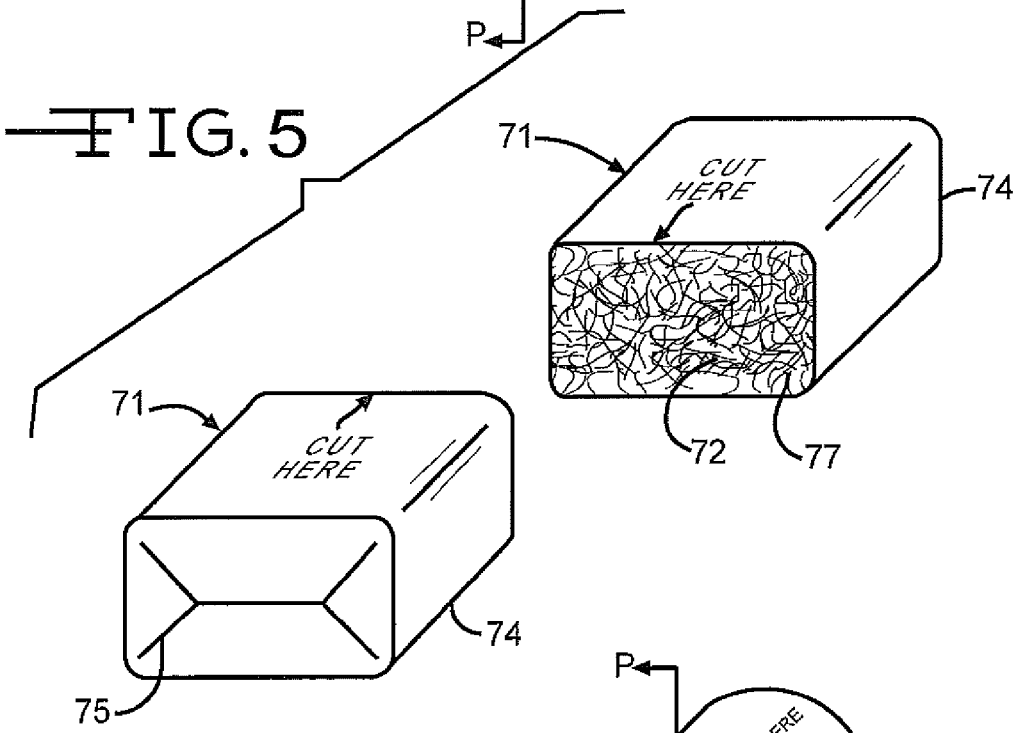
FIG. 5 is a perspective view of half packages of compressed blowing wool.

In one embodiment as shown in FIG. 4, the package 70 includes a body of the compressed blowing wool encapsulated by a bag 74. A slit 76 extends through the body of compressed blowing wool and the bag 74 and partially divides the package 70. In one embodiment, the slit 76 is disposed along the length of the package 70 such that the slit divides the package 70 into approximately equal size half packages 71 as shown in FIG. 5. In another embodiment, the package 70 can include multiple slits positioned along the length of the package 70. In this embodiment, the slits divide the package 70 into multiple package segments (not shown). For example, a package 70 having three slits would be divided into four package segments. Each package segment includes a body of compressed blowing wool encapsulated by the bag 74. Each package segment is capable is being fed into the blowing wool machine 10.

As further shown in FIGS. 4 and 5, the slit 76 is configured to be substantially perpendicular to the length of the package 70. A substantially perpendicular slit 76 enables the machine user to readily cut the un-cut portion of the package 70 along a suggested cut line 79. Cutting the package 70 along the suggested cut line 79 ensures that the resulting half packages 71 are capable of being readily fed into the machine 10. However, it should be understood that the slit 76 can be an angled relative to the length of the package 70 and that the angle of the slit 76 relative to the length of the package 70 is not important to the operation of the package 70.

In this embodiment, the package 70 has a length and width which define a major face 80 of the package 70 as shown in FIGS. 4. The slit 76 is positioned along the width of the major face 80 and extends approximately one-half of the width of the package 70. Alternatively, the slit 76 can extend any width of the package 70, up to a maximum of ⅞ of the width of the package 70.

The slit 76 enables the machine user to divide the package 70 into half packages 71 by cutting the package 70 along a suggested cut line 79 as shown in FIGS. 4 and 5. As shown in FIG. 4, the suggested cut line 79 is defined as the un-cut portion of the package 70 taken along a Plane P defined by the slit 76. In one embodiment, the machine user cuts the package 70 along the suggested cut line 79 with a knife. In another embodiment, the machine user cuts the package 70 along the suggested cut line 79 with cutting shears, or any other cutting tool sufficient to divide the package 70 along the suggested cut line 79.

In this embodiment as further shown in FIG. 4, the package 70 incorporating the slit 76 is delivered to the machine user without a protective covering over the slit 76. Alternatively, the package 70 may include a protective covering 81 to protect the body 72 of blowing wool from dirt, water and other foreign contaminants during the period of time in which the package 70 is in storage or delivery. The protective covering 81 could be a see-through film, or any other covering sufficient to protect the package 70 from foreign contamination.

In one embodiment as shown in FIG. 4, the package 70 includes a plurality of images 78 disposed on the bag 74. The images 78 are disposed on the bag 74 by various methods including printing on the bag or by stickers disposed on the bag 74 or by any other method sufficient to dispose images on the bag 74. The images 78 include instructions to the machine user for cutting the package 70 along the suggested cut line 79, or cutting the package 70 in another package 70 location. In another embodiment, the images 78 include instructions informing the machine user on feeding the half-packages 71 into the machine 10. In yet another embodiment, the images 78 include instructions to the machine user for disposal of the bag 74 after the body 72 of blowing wool has been fed into the chute 14. In another embodiment, the plurality of images 78 includes safety messages or warnings to the machine user.

Figure 6:
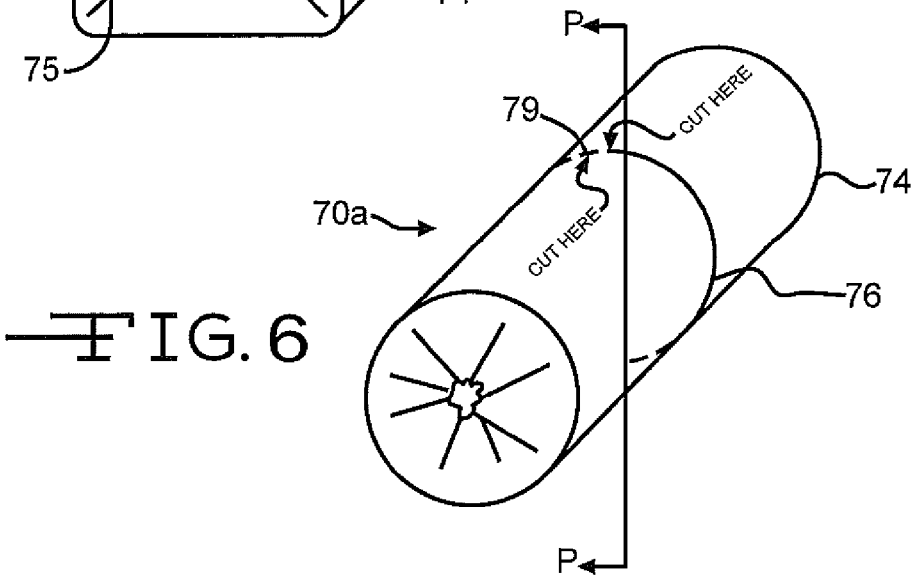
FIG. 6 is a perspective view of an alternate embodiment of a package of blowing wool having a round cross-sectional shape.

As previously discussed and as shown in FIG. 3, the chute 14 has a substantially rectangular cross-sectional shape that approximates the substantially cross-sectional shape of the package 70. In another embodiment, the chute 14 may have a round cross-sectional shape that approximates the cross-sectional shape of a package 70*a* of blowing wool in roll form, as shown in FIG. 6. In this embodiment, the slit 76 extends into the package 70*a* to extent of one-half of the diameter of the package 70*a* and is disposed to be substantially perpendicular to the length of the package 70*a* as defined by slit plane P. As discussed previously, the slit 76 enables the machine user to readily cut the package 70*a* along the suggested cut line 79 thereby forming half packages.

In general operation, packages 70 of compressed blowing wool are provided to the machine user. The packages 70 include a slit 76 which partially divides the package into pre-cut and un-cut portions. Images 78 provided on the package 70 to instruct the machine user on the location of the final cutting of the package 70 and optionally, the images 78 provide a suggested cut line 79. The machine user cuts the un-cut portion of the package 70 along the optional suggested cut line 79 which divides the package 70 into approximate half packages 71. Each half package 71 includes a bag end 75 and an open end 77 as shown in FIG. 5. The machine user grips the bag end 75 of the half package 71 and feeds the open end 77 of the half package 71 into the chute 14 of the blowing wool machine 10. The machine user continues gripping the bag end 75 as the blowing wool 72 is fed into the chute 14. After the blowing wool 72 has been fed into the chute 14, the machine user withdraws the empty bag 74 from the machine 10.

Figure 7:
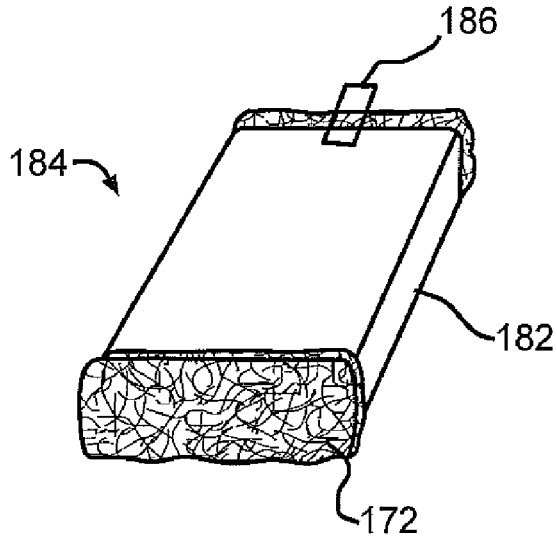
FIG. 7 is a perspective view of an insulation pack.

In another embodiment as shown in FIG. 7, the body 172 of blowing wool is encapsulated in a sleeve 182 to form an insulation pack 184. The sleeve 182 is made of a polymeric material, such as polyethylene, although any type of material suitable for maintaining the blowing wool in the desired compression can be used. While the sleeve 182 shown in FIG. 7 is a one piece member, the sleeve 182 is defined to be any material or structure, such as bands, film or glue, sufficient to maintain the body 172 of blowing wool in the desired compression.

An optional gripping tab 186 is connected to the sleeve 182 and extends past the end of the sleeve 182. The gripping tab 186 is gripped by the machine user as the insulation pack 184 is fed into the chute 14 and allows the machine user to easily retain the sleeve 182 after the blowing wool has been fed into the machine 10. While a single gripping tab 186 is shown in FIG. 7, it should be understood that more than one gripping tab 186 may be connected to the sleeve 182. The gripping tab 186 can be any material, such as plastic, sufficient to be gripped by the machine user and retain the sleeve 182 as the insulation pack 184 is fed into the machine 10.

Figure 8:
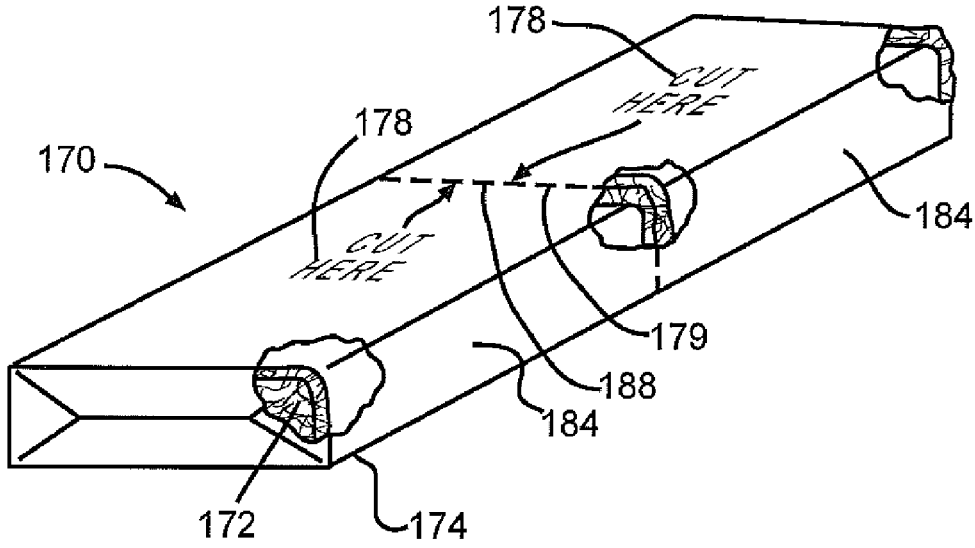
FIG. 8 is a perspective view of a package of blowing wool having insulation packs assembled end-to-end and encapsulated by a bag.
Figure 9:
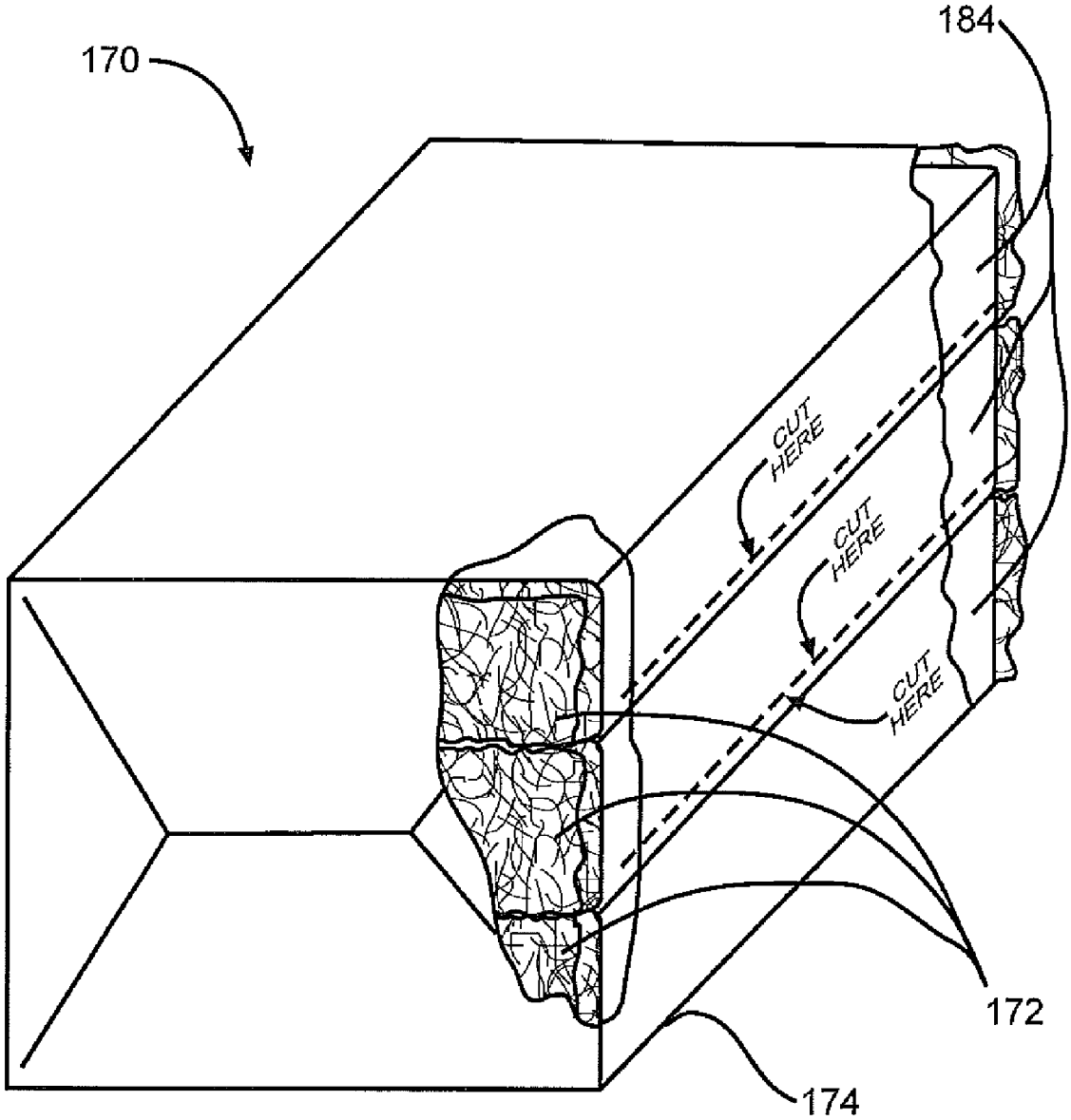
FIG. 9 is a perspective view of an alternate package of blowing wool having insulation packs assembled by stacking and encapsulated by a bag.

As shown in FIG. 8, at least two insulation packs 184 can be assembled together end-to-end. The end-to-end insulation packs 184 are encapsulated with a bag 174 to form a package 170. As discussed previously, the bag 174 can be any material, such as a polymeric material, suitable to provide a waterproof barrier against water, dirt and other deleterious effects. By using a polymeric material for the bag 174, the compressed blowing wool will be protected from the elements during transportation and storage of the package 170. As shown in FIG. 8, the insulation packs 184 can be assembled together end-to-end and encapsulated by the bag 174. In another embodiment, the insulation packs 184 can be stacked as shown in FIG. 9 and encapsulated by the bag 174 or assembled together in any other manner to provide a convenient package 170.

In one embodiment as shown in FIG. 8, the package 170 can include a plurality of images 178 disposed on the bag 174. The images 178 can be disposed on the bag 74 in a manner similar to that previously discussed. The images 178 can include suggested cut lines 179 and instructions to the machine user for opening the package 170 or instructions for loading the insulation packs 184 into the machine 10.

In general operation of this embodiment packages 170 are provided to the machine user. The packages 170 include images 178 provided on the package 170 instructing the machine user on opening of the package 170. Optionally, the images 178 provide a suggested cut line 179 for opening the package 170. As an additional option, the package 170 may include perforations 188 enabling the machine user to readily open the package 170. The machine user opens the package 170 at the prescribed opening locations by cutting the package 170 or by the opening method provided by the images 178. The machine user grips an insulation pack 184 by the optional gripping tabs 186 and feeds the insulation pack 184 into the chute 14 of the blowing wool machine 10. The machine user continues gripping the gripping tabs 186 as the blowing wool 172 is fed into the chute 14. After the blowing wool 172 has been fed into the chute 14, the machine user withdraws the empty sleeve 182 from the machine 10.

Figure 10:
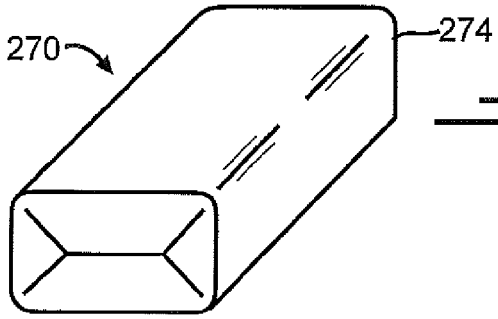
FIG. 10 is a perspective view of an alternate embodiment of a package of compressed blowing wool.

In another embodiment as shown in FIG. 10, a package 270 of compressed blowing wool includes a bag 274 that encapsulates a body of compressed blowing wool. The package 270, bag 274 and compressed blowing wool are the same as or similar to the package 70, bag 74 and compressed blowing wool illustrated in FIG. 4 and discussed above.

Figure 11:
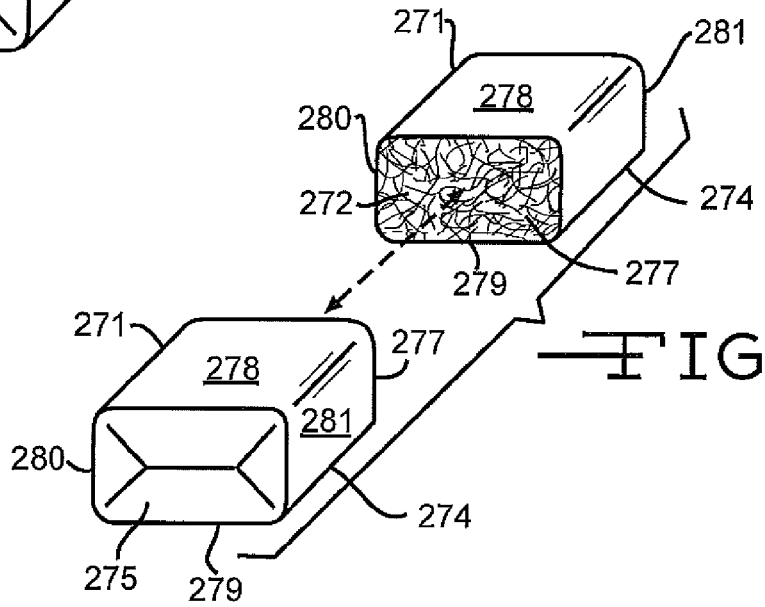
FIG. 11 is a perspective view of the package of compressed blowing wool of FIG. 10 divided into partial packages.

Referring now to FIG. 11, the package 270 is divided into partial packages 271. The package 270 can be divided into the partial packages 271 in any desired manner. The partial packages 271 can be the same as or similar to the partial packages 71 described above and illustrated in FIG. 5. The partial packages 271 include a body of compressed blowing wool 272 encapsulated by a portion of the bag 274. The partial packages 271 are capable is being fed into the blowing wool machine 10.

As shown in FIG. 11, the partial packages 271 include a bag end 275, an open end 277, a top 278, a bottom 279 and opposing sides 280 and 281. The open end 277 of the partial packages 271 exposes the body of compressed blowing wool 272. Optionally, the exposed body of compressed blowing wool 272 in the open end 277 of the partial packages 271 can be covered with a covering, such as for example a suitable transparent film, configured to provide protection to the exposed body of compressed blowing wool. As will be explained in more detail below, the partial packages 271 can be rejoined in various manners to form an assembled package 290.

Figure 12A:
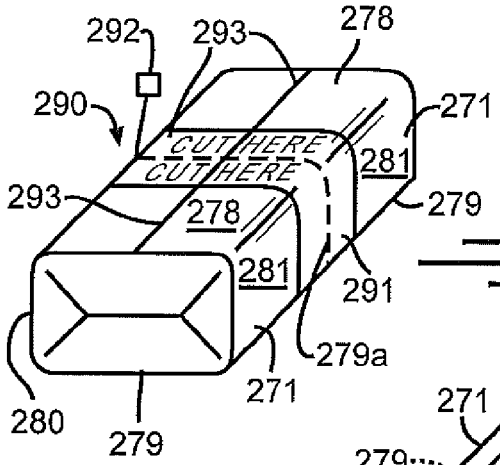
FIG. 12*a* is a perspective view of the partial packages of compressed blowing wool of FIG. 11 rejoined to form an assembled package.
Figure 12B:
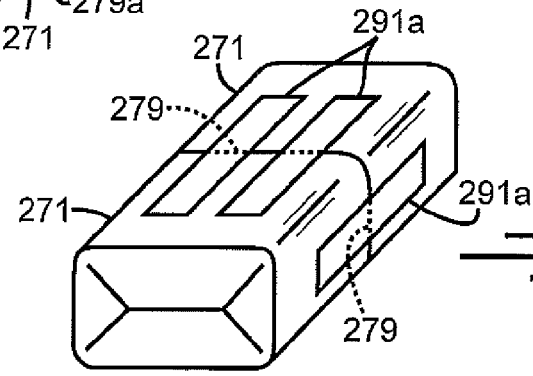
FIG. 12*b*is a perspective view of an alternate embodiment of the rejoined partial packages of compressed blowing wool of FIG. 11 illustrating discontinuous tape segments.

Referring to a first embodiment of an assembled package 290 shown in FIG. 12*a*, the partial packages 271 have been rejoined such that the exposed bodies of compressed blowing wool 272 in the open ends 272 of the partial packages 271 are substantially in contact with each other and the tops 278, bottoms 279 and opposing sides 280 and 281 of the respective partial packages 271 substantially align. The term "substantially in contact" as used herein, is defined to mean the exposed bodies can be in actual physical contact with each other or may have a slight separation from each other. The aligned partial packages 271 are joined together by a joining mechanism 291 configured to span the open ends 272 of the partial packages 271. In the illustrated embodiment, the joining mechanism 291 can be any desired structure, device or mechanism, such as for example adhesive or heat sealed tape, sufficient to join the partial packages 271 into the assembled package 290. In the illustrated embodiment, the joining mechanism 291 extends continuously around the partial packages 271. However, it should be appreciated that discontinuous joining mechanisms 291 a can be used as shown in FIG. 12*b*.

Referring again to FIG. 12*a*, the joining mechanism 291 includes a suggested cut line 279*a*. The suggested cut line 279*a* extends circumferentially around the assembled package 290 and is configured as the location in which a machine user opens the assembled package 290, thereby exposing the partial packages 271. The suggested cut line 279*a* can be the same as or similar to the suggested cut line 79 described above and illustrated in FIG. 4. Optionally, the joining mechanism 291 can include any desired visual characteristic, such as for example colors, patterns or allows or combinations thereof, configured to draw the attention of the machine user to the suggested cut line 279*a*.

Optionally, the suggested cut line 279*a* can be provided with a tear-away mechanism 292 configured to separate the assembled package 290 into the partial packages 271. One non-limiting example of a tear-away mechanism 292 is a ripcord. However other desired tear-away mechanisms can also be used.

In one embodiment as shown in FIG. 12*a*, the partial packages 271 and/or the joining mechanism 291 can include a plurality of images 293. The images 293 can be the same as or similar to the images 78 described above and shown in FIG. 4.

In general operation, the assembled packages 290 of compressed blowing wool are provided to the machine user. Images 293 provided on the partial packages 271 and/or the joining mechanism 291 instruct the machine user on the location of the suggested cut line 279*a*. The machine user cuts the assembled package 290 along the suggested cut line 279*a* which divides the assembled package 290 into the partial packages 271. The partial packages 271 are loaded into the blowing wool machine 10 in the same manner as described above for the half packages 71.

Figure 13:
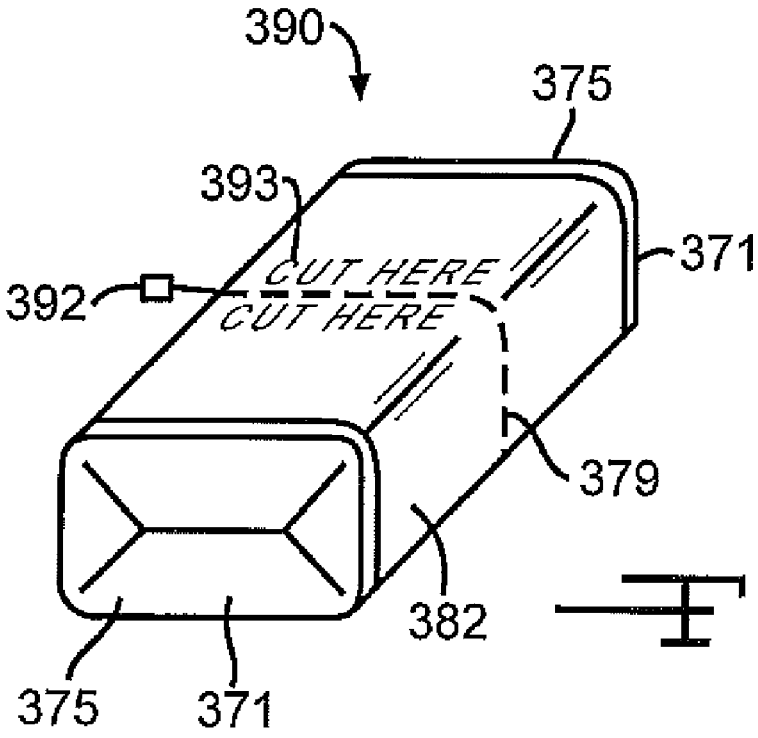
FIG. 13 is a perspective view of an alternate embodiment of the rejoined partial packages of compressed blowing wool of FIG. 11 illustrating a sleeve

Referring now to FIG. 13, another embodiment of an assembled package 390 is illustrated. In this embodiment, partial packages 371 are joined together within a sleeve 382 such that the bag ends 375 of the partial packages 371 extend beyond the sleeve. The partial packages 371 can be the same as or similar to the partial packages 71 described above and illustrated in FIG. 5. Similarly, the sleeve 382 can be the same as or similar to the sleeve 182 described above and as shown in FIG. 7. While the sleeve 382 shown in FIG. 13 is a one piece member, the sleeve 382 can be any desired material or structure, such as bands or netting sufficient to join the partial packages 371 and form the assembled package 390. Optionally, the assembled package 390 can include a suggested cut line 379, tear-away mechanism 392 and indicia 393. The suggested cut line 379, tear-away mechanism 392 and indicia 393 can be the same as or similar to the suggested cut line 279*a*, tear-away mechanism 292 and indicia 293 described above and shown in FIG. 12*a*.

Figure 14:
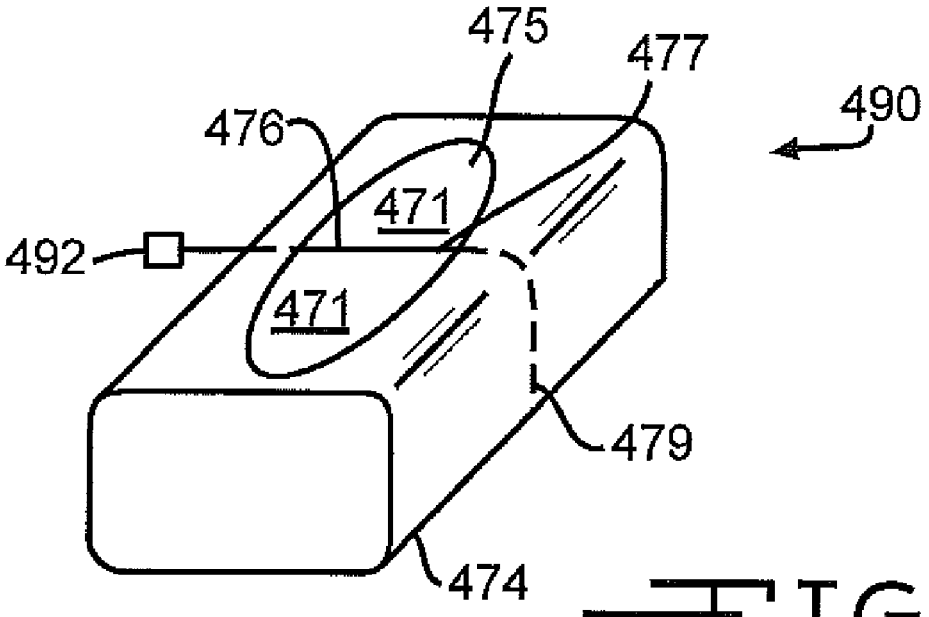
FIG. 14 is a perspective view of an alternate embodiment of the rejoined partial packages of compressed blowing wool of FIG. 11 illustrating a bag having an opening.

Referring now to FIG. 14, a third embodiment of an assembled package 490 is illustrated. In this embodiment, partial packages 471 are joined together in a bag 474. The partial packages 471 can be the same as or similar to the partial packages 71 described above and illustrated in FIG. 5. Similarly, the bag 474 can be the same as or similar to the bag 174 described above and as shown in FIG. 9. In the illustrated embodiment, the bag 474 includes an opening 475 configured to expose a scam 476 formed by the open ends 477 of the partial packages 471. Optionally, the assembled package 490 can include a suggested cut line 479, tear-away mechanism 492 and indicia (not shown). The suggested cut line 479, tear-away mechanism 492 and indicia can be the same as or similar to the suggested cut line 279*a*, tear-away mechanism 292 and indicia 293 described above and shown in FIG. 12*a*. Optionally, the open ends 477 of the partial packages 471 can be covered with a covering, such as for example a suitable transparent film, configured to provide protection to the exposed body of compressed blowing wool.

Figure 15:
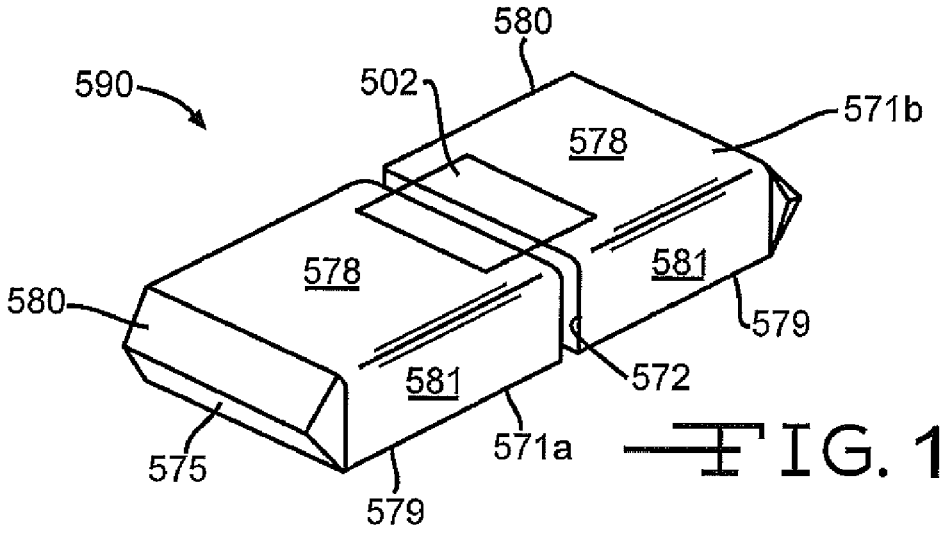
FIG. 15 is a perspective view of an alternate embodiment of the rejoined partial packages of compressed blowing wool of FIG. 11 illustrating a hinge joining the partial packages.

Referring now to FIG. 15, another embodiment of an assembled package 590 is illustrated. In this embodiment, partial packages 571*a* and 571*b* are joined together by a hinge 502. The partial packages 571*a* and 571*b* can be the same as or similar to the partial packages 71 described above and illustrated in FIG. 5. The partial packages 571*a* and 571*b* include a top 578, a bottom 579, opposing sides 580 and 581, an open end 572 and a closed end 575. Optionally, the open end 572 of the partial packages 571 a and 571 b can be covered with a covering, such as for example a suitable transparent film, configured to provide protection to the exposed body of compressed blowing wool. The hinge 502 is positioned to connect the tops 578 of the partial packages 571 and is configured for flexing. The hinge 502 can be made out of any desired material, such as for example a polymeric material, sufficient for flexing.

Figure 16:
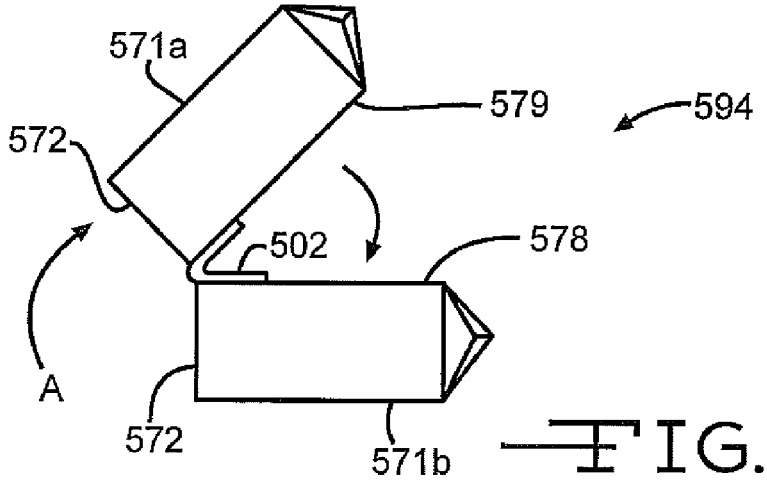
FIG. 16 is a side view in elevation of the partial packages and hinge of FIG. 15 illustrated in a rotating position.

Referring now to FIG. 16, the partial package 571*a* is folded about the hinge 502 in the direction indicated by arrow A, such that the bottom 579 of partial package 571*a* rests on the top 578 of partial package 571*b*, thereby forming stacked package 594. The stacked package 594 includes the aligned open ends 572 of the partial packages 571*a* and 571*b*.

Figure 17:
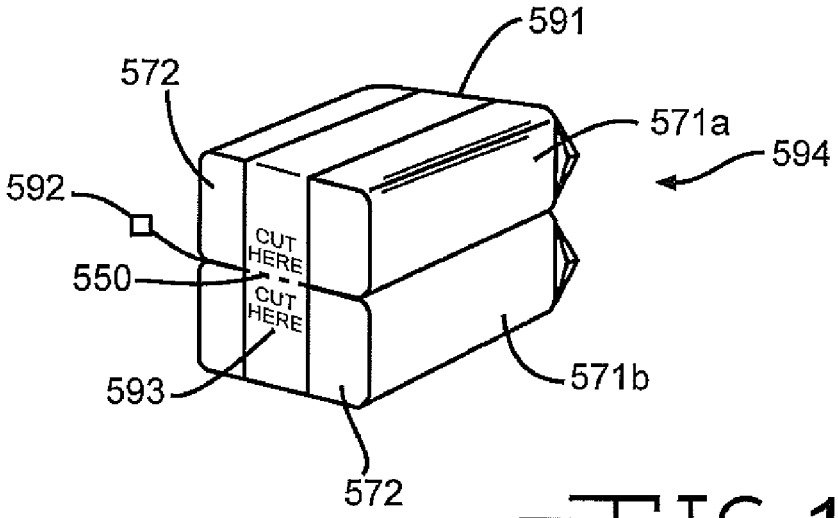
FIG. 17 is a perspective view of the partial packages of compressed blowing wool of FIG. 15 illustrated in a stacked position.

As shown in FIG. 17, the stacked package 594 is bound by a binding mechanism 591. The binding mechanism 591 is configured to maintain the partial packages 571*a* and 571*b* in the folded position during shipment and handling at the installation site. The binding mechanism 591 can be any desired material or combination of materials, including the non-limiting examples of tape and heat shrink wrap. In the illustrated embodiment, the width of the binding mechanism is less than the width of the partial packages 571*a* and 571*b*. Alternatively, the width of the binding mechanism can be substantially the same as the width of the partial packages 571*a* and 571*b*, thereby providing protection of the open ends 572 of the partial packages 571*a* and 571*b* against weathering elements.

Optionally, the open ends 572 of the partial packages 571*a* and 571*b* can be covered with a desired protective material (not shown) prior to the stacked package 594 being bound with the binding mechanism 591. Any desired protective material can be used.

Referring again to FIG. 17, optionally, the stacked package 594 can include a suggested cut line 550, tear-away mechanism 592 and indicia 593. The suggested cut line 550, tear-away mechanism 592 and indicia 593 can be the same as or similar to the suggested cut line 279*a*, tear-away mechanism 292 and indicia 293 described above and shown in FIG. 12*a*.

Figure 18:
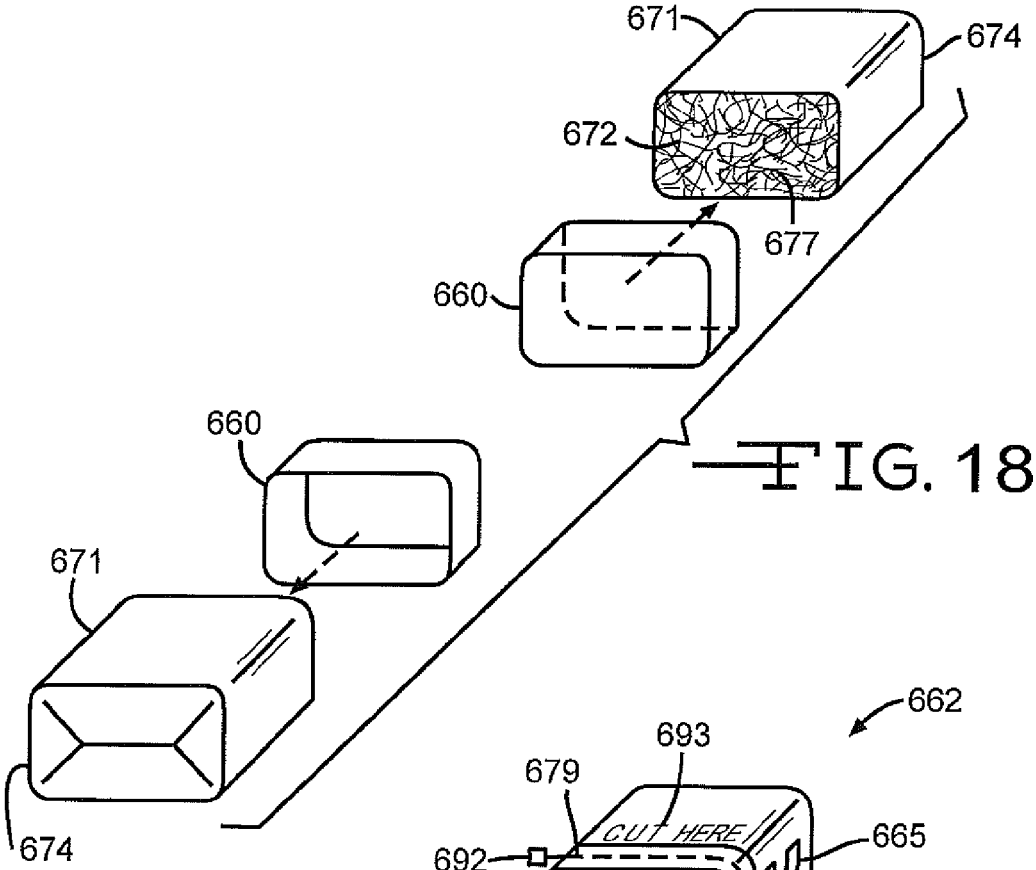
FIG. 18 is a perspective exploded view of an alternate embodiment of the partial packages of compressed blowing wool of FIG. 11 illustrating a protective cap positioned over an open end of the partial packages.
Figure 19:
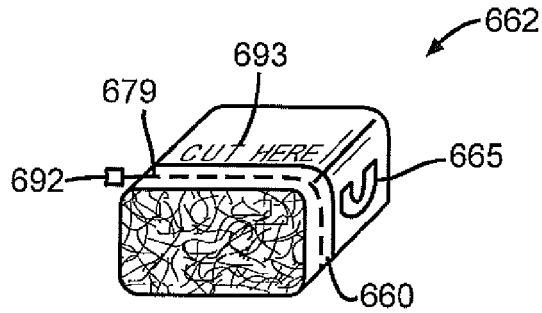
FIG. 19 is a perspective view of a partial package of compressed blowing wool of FIG. 18 illustrating the protective cap and a suggested cut line.

In another embodiment as shown in FIG. 18, partial packages 671 have been formed as previously described for the partial packages 71 as shown in FIG. 5. The partial packages 671 includes a body of compressed blowing wool 672 encapsulated by a portion of the bag 674 and an open end 677. Generally, in this embodiment, the open ends 677 of the partial packages 671 are covered by a protective cap 660 thereby forming covered partial packages 662 as shown in FIG. 19. The covered partial packages 662 can either be shipped to an installation site, or two or more covered partial packages 662 can be combined to form an assembled package 690 as shown in FIG. 20.

Referring again to FIG. 18, the caps 660 are configured to encapsulate the open ends 677 of the partial packages 671 thereby providing a substantially waterproof barrier against water, dirt and other deleterious effects. In the illustrated embodiment, the caps 660 are made of a polymeric material, such as polyethylene, although any type of material suitable for encapsulating the open ends 677 of the partial packages 671 can be used. The caps 660 can be attached to the bags 674 in any desired manner.

Referring now to FIG. 19, a covered partial package 662 is illustrated. While the cap 660 is illustrated as being transparent, it should be appreciated that the cap 660 can be opaque or translucent. Optionally, the cap 660 can include a suggested cut line 679, a tear-away mechanism 692 and indicia 693. The suggested cut line 679, tear-away mechanism 692 and indicia 693 can be the same as or similar to the suggested cut line 279*a*, tear-away mechanism 292 and indicia 293 described above and illustrated in FIG. 12*a*. As another option, the covered partial package 662 can include a handle 665 configured for lifting and transporting the covered partial package 662. The handle 665 can have any desired structure and can be positioned on the package covered partial package 662 in a desired location.

Figure 20:
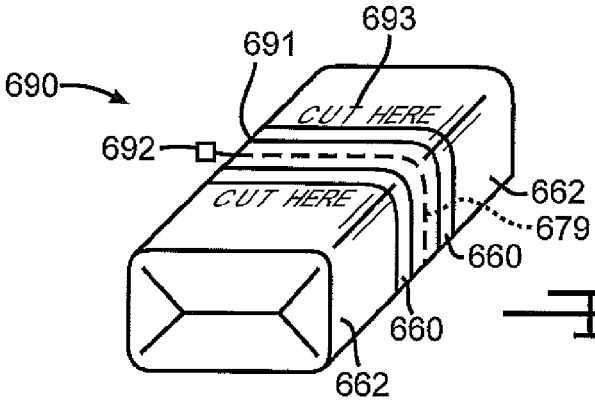
FIG. 20 is a perspective view of the partial packages of compressed blowing wool of FIG. 18 rejoined to form an assembled package.

Referring now to FIG. 20, a quantity of two covered partial packages 662 have been joined such that the caps 660 of the covered partial packages 671 are substantially in contact with each other. The joined covered partial packages 662 form assembled package 690. The covered partial packages 662 are joined together by a joining mechanism 691 configured to span the caps 660 of the covered partial packages 662. The joining mechanism 691 can be the same as or similar to the tape 291 described above and illustrated in FIG. 12*a*.

Optionally, the assembled package 690 can include a suggested cut line 679, a tear-away mechanism 692 and indicia 693. The suggested cut line 679, tear-away mechanism 692 and indicia 693 can be the same as or similar to the suggested cut line 279*a*, tear-away mechanism 292 and indicia 293 described above and illustrated in FIG. 12*a*.

In general operation, the assembled packages 690 are provided to the machine user. Optional indicia 693 provided on the assembled package 690 and/or the tape 691 can instruct the machine user on the location of the suggested cut line 679. The machine user cuts the assembled package 690 along the suggested cut line 679 which divides the assembled package 690 into the covered partial packages 662. The machine user removes the cap 660 as instructed by indicia 693 positioned on the covered partial packages 662. Finally, the partial packages 671 are loaded into the blowing wool machine 10 in the same manner as described above for the half packages 71.

The principle and mode of operation of this loosefill package have been described in its preferred embodiments. However, it should be noted that the loosefill package blowing wool machine may be practiced otherwise than as specifically illustrated and described without departing from its scope.

What is claimed is:

1. A package of compressed blowing wool comprising:

at least two partial packages of compressed blowing wool, the partial packages having a body of compressed blowing wool encapsulated by a bag, the partial packages including an open end and a closed end, the open ends of the partial packages being configured to expose the body of compressed blowing wool; and a joining mechanism configured to join the partial packages into the package;

wherein the partial packages are joined such that the exposed bodies of compressed blowing wool in the open ends are substantially in contact with each other, wherein the package is configured for separation into the partial packages, and wherein the partial packages are configured for loading into a blowing wool machine.

2. The package of claim 1 in which the blowing wool is compressed within the partial packages to a compression ratio of at least 10:1.

3. The package of claim 1 in which the package has a height, width and length, and wherein the height is approximately 8 inches, the width is approximately 19 inches and the length is approximately 38 inches.

4. The package of claim 1 in which the joining mechanism is a sleeve.

5. The package of claim 1 in which the joining mechanism extends continuously around the partial packages.

6. The package of claim 1 in which the joining mechanism includes a suggested cut line.

7. The package of claim 6 in which the joining mechanism includes visual characteristics configured to draw the attention of a machine user to the suggested cut line.

8. The package of claim 6 in which the suggested cut line includes a tear-away mechanism.

9. The package of claim 1 in which protective caps cover the open end of the partial packages.

10. A package of compressed blowing wool comprising:

at least two partial packages of compressed blowing wool, the partial packages having a body of compressed blowing wool encapsulated by a bag, the partial packages including an open end and a closed end, the open ends of the partial packages being configured to expose the body of compressed blowing wool;

protective caps configured to cover the open ends of the partial packages; and a joining mechanism configured to join the partial packages into the package;

wherein the partial packages are joined such that the protective caps are substantially in contact with each other, wherein the package is configured for separation into the partial packages, and wherein the partial packages are configured for loading into a blowing wool machine.

11. The package of claim 10 in which the protective caps are made of a polymeric material.

12. The package of claim 10 in which the protective caps are made of a transparent material.

13. The package of claim 10 in which the protective caps include a suggested cut line.

14. A method of forming a package of compressed blowing wool, the method comprising:

compressing a body of blowing wool;

encapsulating the body of compressed blowing wool in a bag;

dividing the bag of compressed blowing wool into partial packages, the partial packages having an open end and a closed end, the open ends of the partial packages being configured to expose the body of compressed blowing wool; and joining the partial packages thereby forming the package of compressed blowing wool, wherein the partial packages are joined such that the exposed bodies of compressed blowing wool in the open ends are substantially in contact with each other, wherein the package is configured for separation into the partial packages, and wherein the partial packages are configured for loading into a blowing wool machine.

15. The method of claim 14 in which protective caps cover the open end of the partial packages.

16. The method of claim 14 in which the partial packages are joined by a joining mechanism, wherein the joining mechanism extends continuously around the partial packages.

17. The method of claim 16 in which the joining mechanism is tape.

18. A method of distributing blowing wool from a package of compressed blowing wool, the method comprising:

providing a package of compressed blowing wool, the package including at least two partial packages of compressed blowing wool, the partial packages having a body of compressed blowing wool encapsulated by a bag, the partial packages including an open end and a closed end, and a joining mechanism configured to join the partial packages into the package, the open ends of the partial packages being configured to expose the body of compressed blowing wool, wherein the partial packages are joined such that the exposed bodies of compressed blowing wool in the open ends are substantially in contact with each other, wherein the package is configured for separation into the partial packages, and wherein the partial packages are configured for loading into a blowing wool machine cutting the package along a suggested cut line such that the package divides into the partial packages;

gripping the closed end of the partial package;

feeding the open end of the partial package into a machine for shredding and picking apart the blowing wool; and withdrawing the empty partial package from the machine.

19. The method of claim 18 in which the partial packages include indicia, wherein the indicia instructions for disposal of the bag.

20. The method of claim 18 in which the package includes indicia, wherein the indicia includes a suggested cutting line.

* * * * *